US006158159A

United States Patent [19]

Zekas

[11] Patent Number: 6,158,159

[45] Date of Patent: Dec. 12, 2000

[54] GUN SIGHTING REST

[75] Inventor: Anthony P. Zekas, Allison Park, Pa.

[73] Assignee: Four Sight, Inc., Pittsburgh, Pa.

[21] Appl. No.: 09/201,652

[22] Filed: Nov. 30, 1998

[51] Int. Cl.[7] ..... F41C 27/00

[52] U.S. Cl. ..... 42/94

[58] Field of Search ..... 42/94; 89/37.04

[56] References Cited

U.S. PATENT DOCUMENTS

| | | | |
|---|---|---|---|
| 2,569,435 | 9/1951 | Martin | 42/94 |
| 3,012,350 | 12/1961 | Wold | 89/37.04 |
| 3,225,656 | 12/1965 | Flaherty et al. | 42/94 |
| 3,947,988 | 4/1976 | Besaw | 42/94 |
| 3,964,613 | 6/1976 | Anderson, Jr. | 211/64 |
| 4,409,751 | 10/1983 | Goda et al. | 42/94 |
| 4,449,314 | 5/1984 | Sorensen | 42/94 |
| 4,807,381 | 2/1989 | Southard | 42/94 |
| 4,873,777 | 10/1989 | Southard | 42/94 |
| 4,972,619 | 11/1990 | Eckert | 42/94 |
| 4,998,944 | 3/1991 | Lund | 42/94 |
| 5,050,330 | 9/1991 | Pilgrim et al. | 42/94 |
| 5,058,302 | 10/1991 | Minneman | 42/94 |
| 5,333,829 | 8/1994 | Bell et al. | 248/634 |
| 5,491,921 | 2/1996 | Allen | 42/94 |
| 5,628,135 | 5/1997 | Cady | 42/94 |

*Primary Examiner*—Charles T. Jordan
*Assistant Examiner*—Denise J Buckley
*Attorney, Agent, or Firm*—Carothers & Carothers

[57] ABSTRACT

A gun sighting rest having a support body of foam plastic material which is unitarily molded to have a base with front and back end spaced upwardly extending U-shaped rests or placement grooves for supporting and engaging the forearm grip of a firearm, such as a rifle or shotgun in spaced relationship. An elevation wedge also molded of the same plastic foam is provided for insertion under the front or back end of the base for adjustably elevating either end as desired. An interlocking tongue and groove friction engagement retainer is provided to adjustably retain the elevation wedge and the base of the gun rest together when in use.

5 Claims, 2 Drawing Sheets

GUN SIGHTING REST

BACKGROUND OF THE INVENTION

The present invention is directed to a gun rest and more specifically to a gun rest having two spaced gun placement grooves or rests for sighting in a rifle or shotgun.

Conventional rifle rests are comprised of sandbags or bean bags which are relatively heavy and cumbersome to transport and store and are susceptible to leakage.

Another type of gun rest is comprised of a frame with spaced gun placement grooves and a special elevating mechanism. This type of gun rest is heavy and expensive to manufacture, does not normally firmly grip the shotgun or rifle to the degree desired and does not sufficiently absorb shock upon firing the shotgun or rifle.

It is a principal object of the present invention to provide an inexpensive light weight gun sighting rest which minimizes the aforementioned disadvantages of the gun rests of the prior art.

SUMMARY OF THE INVENTION

The gun sighting rest of the present invention incorporates a support body of foam plastic material (preferably a combination of expanded polystyrene and polyethylene) having a base with a front end and a back end and two spaced upwardly extending V or U-shaped rests or placement grooves or rests. The grooves are positioned respectively adjacent the front and back ends of the base and are aligned for engaging the forearm grip of a firearm, such as a shotgun or rifle, in spaced relationship for holding the firearm in a shooting position for sighting.

An elevation wedge is provided for insertion under the front or rear end of the base for elevating one end of the rest as desired for properly sighting the firearm. An interlocking retainer is provided for adjustably retaining the base and wedge together.

The wedge is also preferably composed of the same foam plastic material.

The interlocking retainer is provided by one or two longitudinally extending tongue and groove arrangements between the wedge and the bottom of the base whereby the tongue or tongues of one and the groove or grooves of the other may be frictionally inter-engaged at any desired position for elevating the front end or rear end of the gun rest as desired. A side-by-side parallel pair of the tongue and groove arrangement may be provided to insure stability of the interlocking between the elevation wedge and the base of the gun rest.

The gun sighting rest of the present invention is extremely light weight, is extremely shock absorbent and has a high level of resiliency or memory which enables the foam material to substantially return to its original position after being compressed and therefore securely grips the rifle or gun forearm grip. It is further oil resistant and very inexpensive to manufacture.

BRIEF DESCRIPTION OF THE DRAWINGS

Other objects and advantages appear hereinafter in the following description and claims. The drawings show, for the purpose of exemplification, without limiting the scope of the invention or appended claims, certain practical embodiments of the present invention wherein:

DETAILED DESCRIPTION OF A PREFERRED EMBODIMENT

Figure 1:
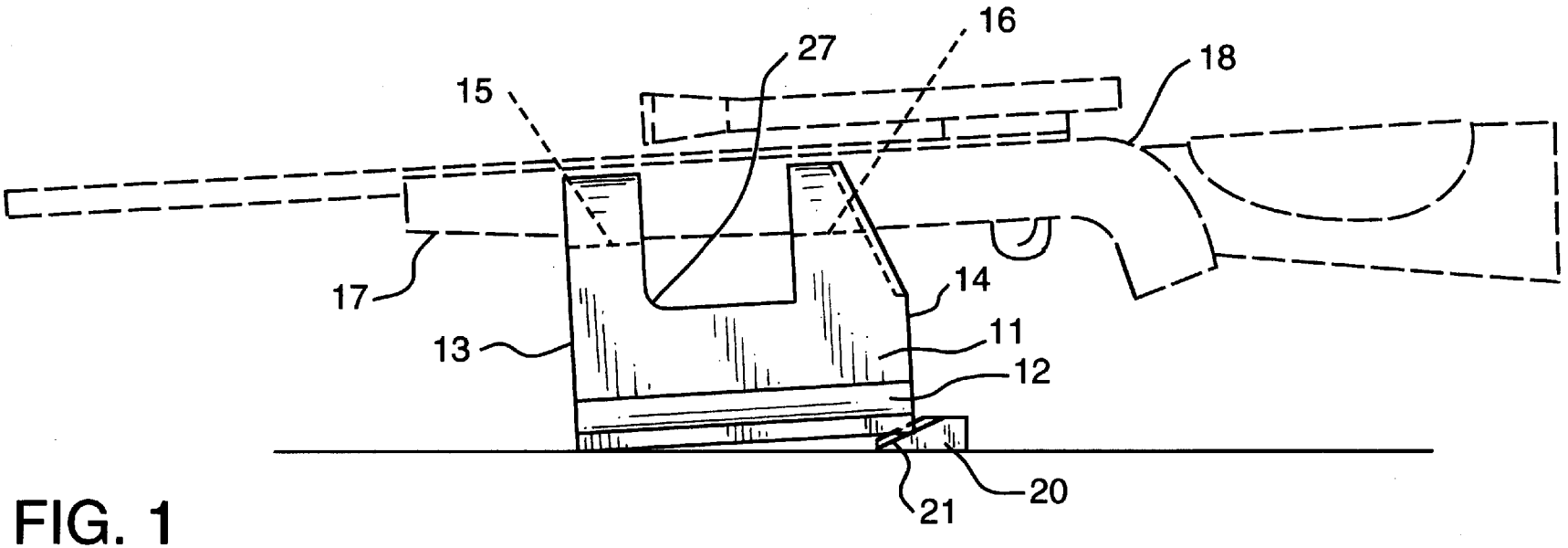
FIG. 1 is a view in side elevation of the gun sighting rest of the present invention supporting a rifle for sighting.

Referring to the drawings, the gun sighting rest 10 of the present invention is comprised of a support body 11 which is unitarily molded of a combination of expanded polystyrene and polyethylene foam of, for example, two pound density.

The support body 11 has a base 12 with a front end 13 and a back end 14 and two spaced upwardly extending U-shaped rests with placement grooves 15 and 16 respectively adjacent the front and back ends 13 and 14 for engaging a forearm grip 17 of rifle or firearm 18 in spaced relationship as shown for holding the firearm in a shooting position for sighting in the rifle.

Figure 2:
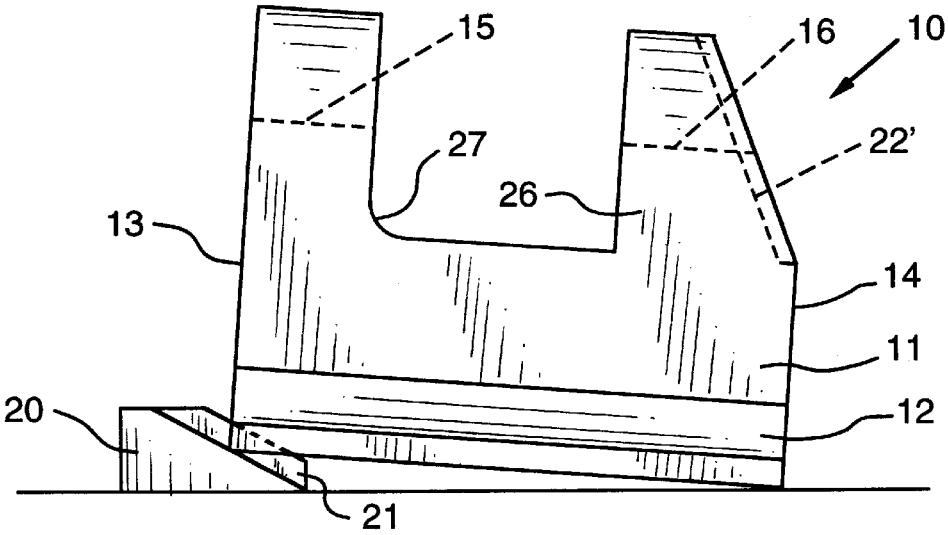
FIG. 2 is an enlarged view of the gun sighting rest shown in FIG. 1 with the elevating wedge elevating the front end of the rest, instead of the back end and without the rifle resting thereon.
Figure 3:
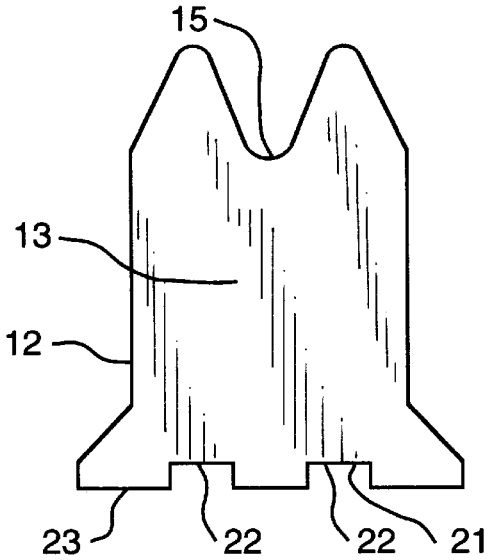
FIG. 3 is a view in left front elevation of the main body portion of the gun sighting rest shown in FIG. 2.
Figure 4:
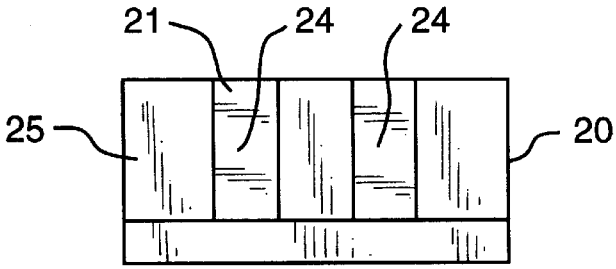
FIG. 4 is a view in right side elevation of the elevation wedge shown in FIG. 2 without the inclusion of the main support body of the gun rest.

An elevation wedge 20, also composed of a combination of expanded polystyrene and polyethylene, is provided for insertion under base 11 for adjustably elevating either the front end 13 of the support body 11 as shown in FIG. 2 or the back end 14 of the support body 11 as shown in FIG. 1.

An interlocking retainer 21 is provided between base 12 and wedge 20 by means of a pair of longitudinally extending grooves 22 in the bottom face 23 of base 12 and corresponding ribs or tongues 24 on the ramped face 25 of wedge 30 which are dimensioned for corresponding adjustable frictional fit in grooves 22 to provide a frictionally interengaging tongue and groove arrangement. This arrangement securely holds the elevation wedge 20 into solid adjustable engagement with the support body 12.

The back U-shaped rest 16 in its upwardly extending body portion 26 is provided with an additional pair of parallel grooves 22' for receiving the ribs or tongues 24 of elevation wedge 20 therein to securely retain the wedge 20 on the support body 11 when the gun sighting rest 10 of the present invention is not in use.

The U or V shaped rests 15 and 16 tightly engage and grip the forearm grip 17 of the rifle 18 due to the high level of resiliency or memory of the foam material. The plastic foam material is also desirable because it is resistant to oils, is lightweight and provides excellent shock absorption when firing a shotgun or rifle mounted on the rest.

The base portion of the front rest 15 is also provided with a curved portion 27 to provide a hand and thumb rest for the person sighting in the rifle or shotgun.

I claim:

1. A gun sighting rest comprising: a unitary support body of foam plastic material having a base with a front end and back end and two spaced upwardly extending U-shaped rests respectively adjacent said ends and aligned for engaging a forearm grip of a firearm in spaced relationship for holding the firearm in a shooting position, an elevation wedge for insertion under said base for adjustably elevating a desired one of said ends, and an interlocking retainer for adjustably retaining said base and wedge together.

2. The gun sighting rest of claim 1 wherein said wedge is also composed of a foam plastic material.

3. The gun sighting rest of claim 2 wherein said interlocking retainer is comprised of at least one longitudinally extending and frictionally interengaging tongue and groove arrangement.

4. The gun sighting rest of claim 3 wherein said interlocking retainer includes a side-by-side parallel pair of said tongue and groove arrangement.

5. The gun rest of claim 3 wherein said plastic foam is a combination of expanded polystyrene and polyethylene.

* * * * *